US006223481B1

(12) United States Patent
Rickman

(10) Patent No.: US 6,223,481 B1
(45) Date of Patent: May 1, 2001

(54) ROOF CONSTRUCTION

(75) Inventor: Paul Douglas Rickman, Doddinghurst (GB)

(73) Assignee: Rickmans Limited, South Yorkshire (GB)

( * ) Notice: Subject to any disclaimer, the term of this patent is extended or adjusted under 35 U.S.C. 154(b) by 0 days.

(21) Appl. No.: 09/266,319

(22) Filed: Mar. 11, 1999

(30) Foreign Application Priority Data

Mar. 12, 1998 (GB) ..... 9805164

(51) Int. Cl.[7] ..... E04B 7/06; E04B 7/16; E04D 13/00; A01G 9/14

(52) U.S. Cl. ..... 52/90.1; 52/91.1; 52/92.1; 52/92.3; 52/93.2; 52/460; 52/461; 52/639; 52/640; 52/655.1; 52/DIG. 17

(58) Field of Search ..... 52/90.1, 91.1, 52/92.2, 92.3, 93.2, 460, 461, 639, 640, 655.1, DIG. 17, 200

(56) References Cited

U.S. PATENT DOCUMENTS

| | | | | |
|---|---|---|---|---|
| 3,150,463 | * | 9/1964 | Nearing et al. | 52/92.2 X |
| 4,114,330 | * | 9/1978 | Sukolics | 52/460 X |
| 4,261,143 | * | 4/1981 | Rizzo | 52/91.1 X |
| 5,209,031 | * | 5/1993 | Tavano | 52/92.2 |
| 5,826,380 | * | 10/1998 | Wolfe | 52/640 X |
| 5,927,027 | * | 7/1999 | Richardson | 52/DIG. 17 X |

* cited by examiner

*Primary Examiner*—Christopher T. Kent
(74) *Attorney, Agent, or Firm*—Tilton, Fallon, Lungmus & Chestnut

(57) ABSTRACT

The invention relates to a roof construction, assembled from aluminium alloy extrusions and sections which may be cut on site to the appropriate dimensions. There is a ring beam, made from a channel and a ridge member in the form of a central extruded aluminium alloy central box member, the channel and member being essentially of the same section. Thus a relatively small number of different extrusions are required.

20 Claims, 4 Drawing Sheets

ROOF CONSTRUCTION

FIELD OF THE INVENTION

This invention relates to a roof construction suitable for use for a conservatory. In particular, this invention relates to various aspects of a conservatory roof construction, as will be explained hereinafter.

BACKGROUND OF THE INVENTION

Conservatory roofs may be constructed in a number of different ways. Traditionally, timber members have been cut on site to the required size and were then nailed or screwed together. Glazing was then fitted to glazing bars extending from a ridge beam down to a wall plate, laid around the upper surface of the conservatory walls. Such a roof construction is relatively expensive to implement and so many conservatory roofs are now assembled from pre-formed metal sections, either cut remote from the location at which the roof is to be constructed and then assembled on site, or cut and assembled on site, as appropriate, whereafter multi-wall plastics sheeting is fitted to the glazing bars to complete the roof.

A typical conservatory roof assembled from metal sections may have a ring beam extending around the upper surface of the conservatory walls, a ridge member disposed approximately centrally between opposed side walls of the conservatory and higher than the ring beam, and glazing bars extending between the ridge member and the ring beam, sloping downwardly from the ridge member to the ring beam. The ridge member typically is of a relatively complex construction in order to have the required strength and also to permit the affixing thereto of glazing bars, at the appropriate angle. For example, such a ridge member may have a number of different components which are typically aluminium extrusions of complex shapes, suitably affixed together. In addition, one or more folded metal strips may be secured to the ridge member, for example to serve as a capping strip and also as valances to conceal fixings, connections and so on.

The known designs of metal (and usually aluminium alloy) conservatory roof assemblies require the use of a significant number of different extrusions, strips and other sections. For example, it is not uncommon for as many as 60 different sections, strips and so on to be required, ignoring simple fastenings, seals and the like.

SUMMARY OF THE INVENTION

It is accordingly an object of the invention to seek to improve upon known metal conservatory roof constructions, by permitting the use of a relatively small number of different extrusions, sections and other members, while still allowing a versatile and flexible arrangement which may be adapted to different installation requirements.

According to one aspect of the present invention, there is provided a conservatory roof construction comprising a ring beam adapted to be laid around the upper surfaces of the conservatory walls, a ridge member and a plurality of glazing bars extending between the ridge member and the ring beam, the ring beam comprising a channel which defines a surface for supporting the outer ends of the glazing bars, and the ridge member comprising a substantially central member and a pair of channels disposed one to each side of the central member which ridge channels define surfaces for supporting the ridge ends of the glazing bars, the channels of the ridge and of the ring beam being essentially of the same section.

The design and extrusion of the complex sections used in an aluminium conservatory roof represents a significant part of the overall cost of the roof. With the roof construction of the first aspect of this invention, the same sections are employed for the ring beam and in the fabrication of the ridge member. This allows very significant cost savings, both or initial tooling-up and subsequently, during installation. Moreover, the, umber of different components which need to be stocked is reduced, as are the number and quantity of materials needed on site when constructing a roof, and this much simplifies the installation.

In the roof construction of this invention, it is preferred that the ridge and ring beam channels are aluminium alloy extrusions of the same section.

Preferably, each ridge channel may comprise a base wail, a relatively long flange upstanding from one edge of the base wall, and a relatively short flange upstanding from the opposed other edge of the base wall. In this case, the two ridge channels may be mounted with their base walls extending along respective opposed side faces of the central member, with the long flanges of the channels lowermost, and preferably with those long flanges more or less in the same general plane as the lower face of the central member. Thus, the lower long flanges will project laterally away from the central member, whereby the upper ends of the glazing bars may be fitted to the upwardly directed surfaces of those long flanges.

The ring beam channel is preferably mounted with the base wall upstanding from the upper surface of the conservatory walls, with the long flange lowermost and the glazing bars resting either directly or indirectly on the upper short flange. To accommodate the range of angles at which glazing bars could extend, in any given construction, the upper short flange of the channel is preferably arcuate, curving downwardly away from the base wall. In this case, the flanges should be directed away from the interior of the conservatory.

A ridge capping strip may be fitted to the ridge member, both for aesthetic reasons and to impart water-tightness to the construction. Such a ridge capping strip may rest on the short flanges of the two ridge channels, fitted one to each side of the box member. Suitable means should be provided to secure the capping strip in position, such as a plurality of vertically extending bolts held captive in the capping strip at spaced intervals and passing downwardly through an aperture in the central member.

Valance strips, or trims, may be fitted to the inwardly directed face of the base wall of the channels, where serving as a ring beam and to the under sides of the lower flanges, where serving as a part of the ridge member. By having the width of the long flange substantially equal to the width of the central member, and approximately one half of the width of the base wall of the channel, it is possible to employ a single design of valance strip suitable for overlying the long flange. Then, by fitting such valance strips side-by-side, two such strips may be used effectively to trim the upstanding inwardly-directed face of the base wall of the channel where used as a ring beam, and three such strips may be used effectively to trim the downwardly-directed face of the ridge member, made up of the downwardly-directed lowermost face of the central member together with the downwardly-directed faces of the two long flanges of the two ridge channels respectively, secured to the central member, which is preferably a box member. could extend, in any given construction, the upper short flange of the channel is preferably arcuate, curving downwardly away from the base wall. In this case, the flanges should be directed away from the interior of the conservatory.

A ridge capping strip may be fitted to the ridge member, both for aesthetic reasons and to impart water-tightness to the construction. Such a ridge capping strip may rest on the short flanges of the two ridge channels, fitted one to each side of the box member. Suitable means should be provided to secure the capping strip in position, such as a plurality of vertically extending bolts held captive in the capping strip at spaced intervals and passing downwardly through an aperture in the central member.

Valance strips, or trims, may be fitted to the inwardly directed face of the base wall of the channels, where serving as a ring beam and to the under sides of the lower flanges, where serving as a part of the ridge member. By having the width of the long flange substantially equal to the width of the central member, and approximately one half of the width of the base wall of the channel, it is possible to employ a single design of valance strip suitable for overlying the long flange. Then, by fitting such valance strips side-by-side, two such strips may be used effectively to trim the upstanding inwardly-directed face of the base wall of the channel where used as a ring beam, and three such strips may be used effectively to trim the downwardly-directed face of the ridge member, made up of the downwardly-directed lowermost face of the central member together with the downwardly-directed faces of the two long flanges of the two ridge channels respectively, secured to the central member, which is preferably a box member.

According to a second aspect of this invention, there is provided a conservatory roof construction including a ridge member and a plurality of glazing bars each extending away from and having one end supported by the ridge member, said one end of each glazing bar bearing on a respective support plate pivoted to the ridge member, there being means for selectively setting the relative angle between the plate and the ridge member which means comprises an arcuate receptor centred on the pivot axis of the support plate and having a plurality of spaced engagement means with any one of which the end of the support plate remote from its pivotal connection to the ridge member may be engaged.

This aspect of the invention provides a particularly simple, easy to use and effective technique for connecting the glazing bars of a conservatory roof to the ridge member, with the bars extending at a selected required angle. In known constructions, the glazing bars are generally arranged to extend at one of a limited number of angles, which in those known constructions the angles are set by clamping the bars using screw-threaded fasteners to the ridge member and ring beam, at the required disposition. Using the technique of the present invention, the teeth of the arcuate receptor define the angles at which the glazing bars, resting on the support plate, may extend in an effective, and rapid to perform, manner.

The ridge member may have an outwardly projecting flange along each side face and in this case the pivotal connection of the one (upper) end of each glazing bar preferably is arranged at or adjacent the outer end of the flange. Such a pivotal connection may be formed by an inter-engaged headed bead and re-entrant groove provided on the two components pivoted together—and preferably with the bead on the flange and the groove on the underside of the support plate Conveniently, each glazing bar is secured to its support plate by means of a screw-threaded fastener disposed between the pivotal connection of the support plate and the end of the support plate engaged with the receptor.

This second aspect of the invention is most preferably employed with the first aspect, described above. In this case, the flange advantageously is the long flange of the ridge channel extending along a side face of the ridge box member and the receptor is integrally formed with that ridge channel.

According to a third aspect of this invention, there is provided a conservatory roof construction comprising a ring beam adapted to be laid around the upper surfaces of the conservatory walls, a ridge member, a plurality of glazing bars extending between the ridge member and the ring beam, and a valley member disposed between two sections of the roof lying in different planes and also extending between the ridge member and the ring beam, the ridge member comprising a central member and a pair of ridge channels disposed one to each side of the member which ridge channels define surfaces for supporting the ridge ends of the glazing bars and the valley member comprising a central member, a pair of carriers mounted one to each side of the member for supporting the lower ends of glazing bars terminating along the valley, the central member of the ridge member being of substantially the same configuration as the member of the valley member.

It will be appreciated that this third aspect of this invention further reduces the number of different sections required to construct a conservatory roof, using aluminium alloy sections. By connecting the carriers to the same extruded member as is employed for the ridge, a relatively strong valley may be constructed in a simple and effective manner. In a preferred arrangement, one of the central member and the carrier is provided with a irtegrally-formed headed bead and the other of the central member and the carrier is provided with a re-entrant groove into which the headed bead is fitted, thereby to furnish the pivotal connection therebetween.

According to yet another aspect of this invention, there is provided a conservatory roof construction comprising a ring beam adapted to be laid around the surfaces of the conservatory walls, a ridge member and a plurality of glazing bars extending between the ridge member and the ring-beam, the inwardly-directed faces of the ring beam and the ridge member being trimmed with elongate valance strips, each valance strip being of the same configuration. Preferably, two such valance strips arranged side-by-side are employed to trim the inwardly directed face (i.e the vertical face) of each ring beam, and three such valance strips arranged side-by-side are used to trim the inwardly directed face (that is, the downwardly-directed face) of the ridge beam.

In a typical conservatory roof constructed and arranged in accordance with the present invention, any one or more of the aspects of the present invention may be employed. In the specific embodiment of conservatory roof described hereinafter, all four aspects are employed, though it would be possible to use any one, two or three of the aspects, in any particular installation.

BRIEF DESCRIPTION OF THE DRAWINGS

By way of example only, a conservatory roof construction arranged in accordance with the present invention will now be described in detail, with reference being made to the accompanying drawings, in which.

DETAILED DESCRIPTION OF THE INVENTION

Figure 1:
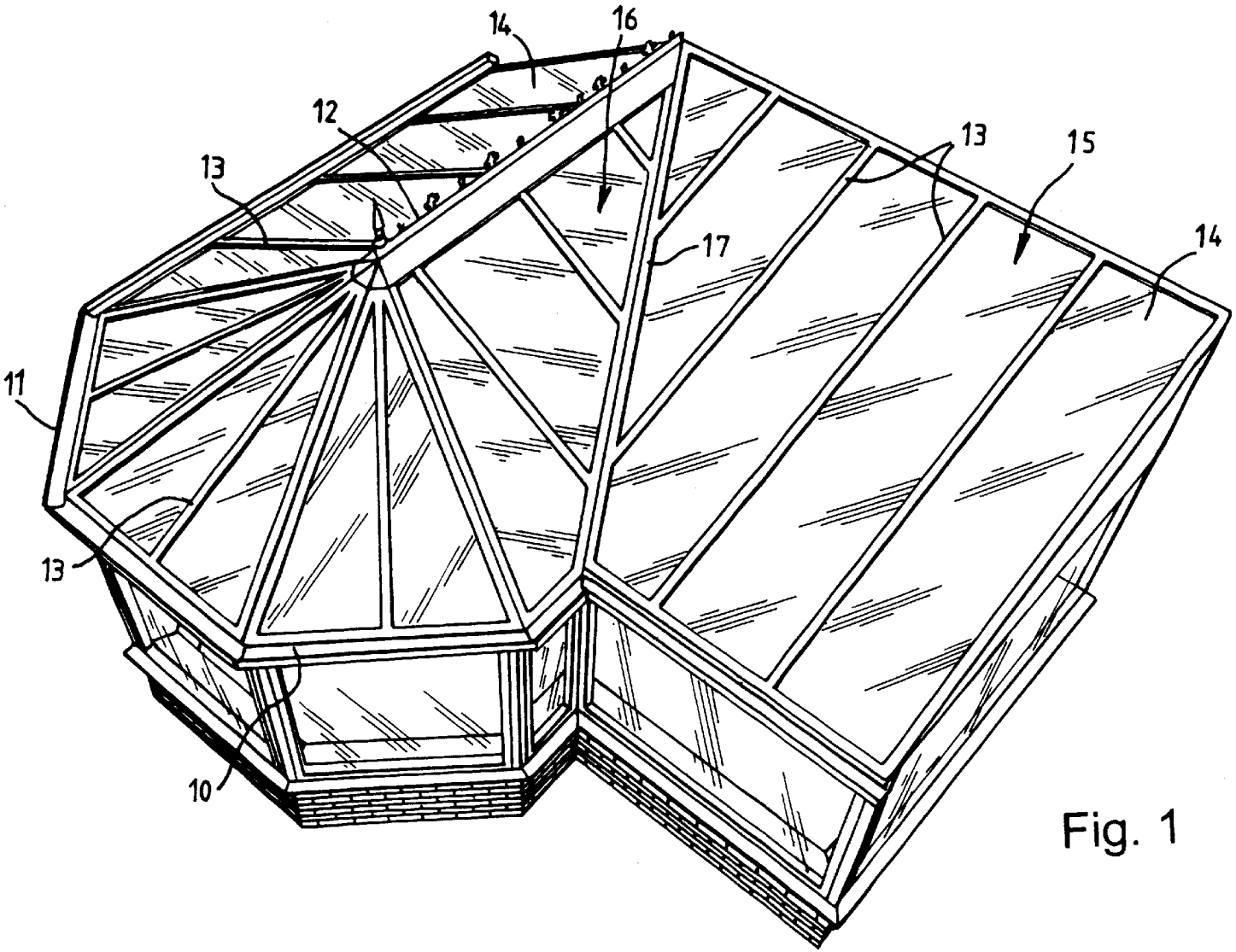
FIG. 1 diagrammatically illustrates a conservatory having the example of roof of this invention.

Referring initially to FIG. 1, there is shown diagrammatically a conservatory roof construction, assembled from aluminium alloy extrusions and sections which may be cut on site to the appropriate dimensions. This roof includes a ring beam 10 fitted with a gutter 11, a ridge member 12 and glazing bars 13 extending between the ring beam 10 and the ridge member 12. Sheets 14 of transparent material, such as of triple-wall polycarbonate, are supported by the glazing bars 13. A valley is formed between side section 15 of the roof and the adjoining section 16, which valley includes a valley member 17 supporting the lower ends of the glazing bars 13 which adjoin that valley.

Figure 2:
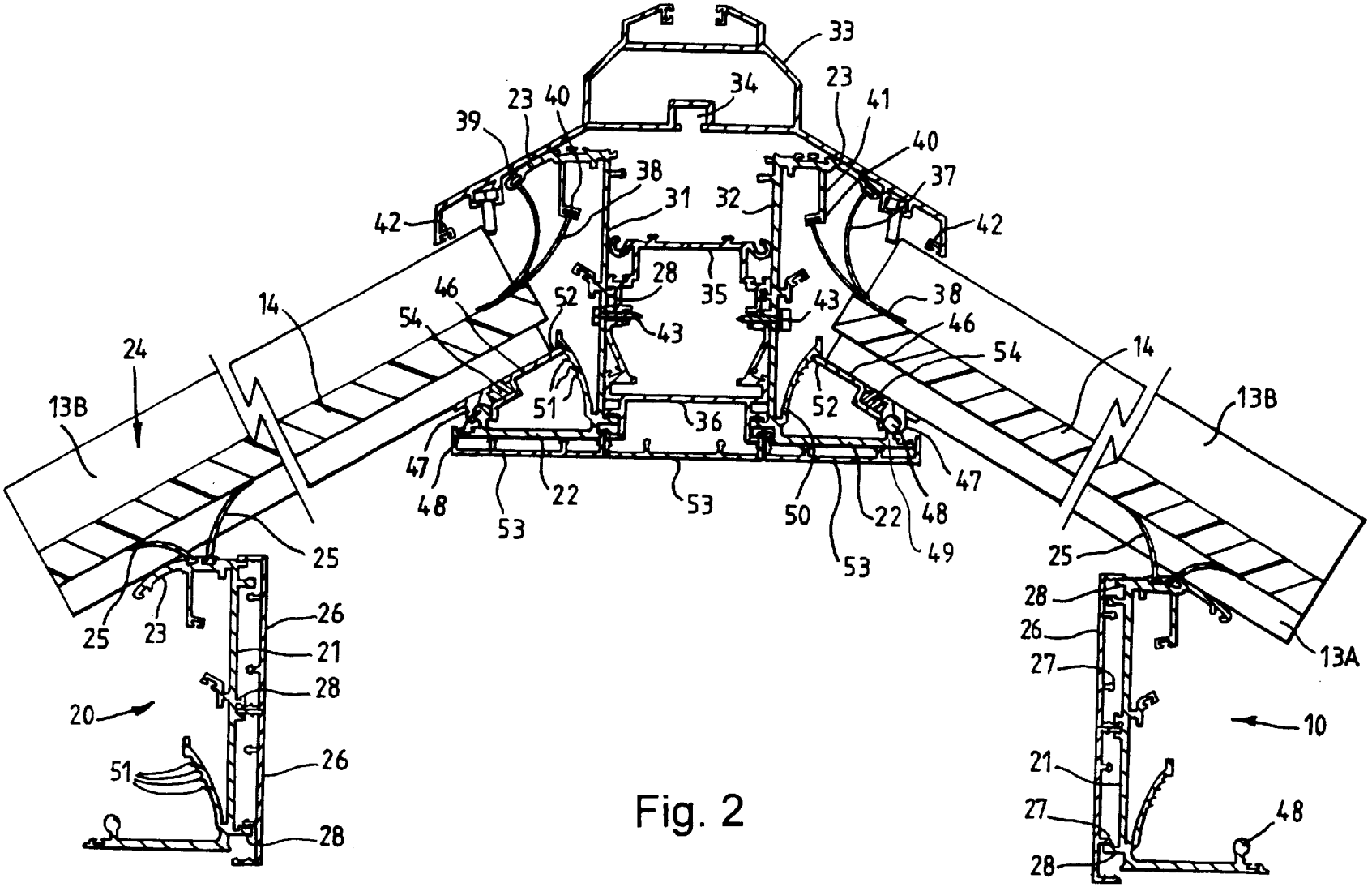
FIG. 2 is a vertical section through the roof of FIG. 1, with the glazing bars shortened for clarity.
Figure 4A:
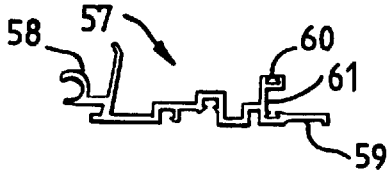
FIGS. 4A to 4F illustrate the six principal sections used in the roof construction of FIGS. 2 and 3.
Figure 4B:
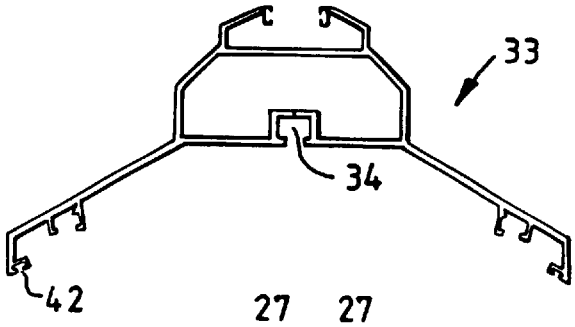

FIG. 2 shows a vertical section through the main part of the roof. The ring beam 10 is formed from an extruded aluminium alloy channel 20 (FIG. 4F) having a base wall 21, a long flange 22 projecting from one edge of the base wall and a short flange 23 projecting from the opposed edge of the base wall. When used as a ring beam, the base wall 21 is vertical, as illustrated in FIG. 2, with the long flange 22 resting on a wall plate laid around the top of the walls of the conservatory. The short flange 23 serves to support the lower ends 24 of the glazing bars 13, suitable sealing members 25 being located in grooves formed in the short flange 23, to effect a seal between the glazing bars and ring beam. The short flange is curved generally towards the long flange, so as to accommodate glazing bars 13 which may fie at an appropriate angle to the horizontal having regard to the dimensions and configuration of the roof construction.

As shown, the channel 20 has the flanges 22 and 23 directed outwardly of the conservatory and the inwardly directed face of the base wall 21 is trimmed with a pair of valance strips 26, disposed side-by-side. These strips 26 (FIG. 4C) are manufactured from extruded plastics or a similar material and have legs 27 permitting those strips to be snap-fitted to corresponding projections 28 provided on the base wall 21 of channel 20.

Figure 2A:
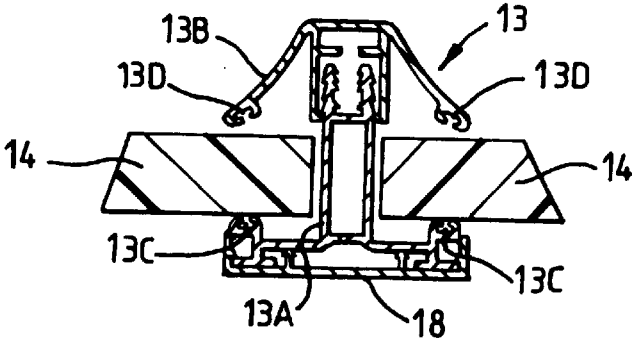
FIG. 2A is a transverse cross-section through a glazing bar shown in FIG. 2.

FIG. 2A is a transverse cross-section through a glazing bar 13, supporting the edges of two sheets 14 of transparent material. The glazing bar is assembled from a central aluminium alloy extrusion 13A and a cap 13B pressed on to the central extrusion after laying of the sheets 14. Seals (not shown) are located in grooves 13C and 13D of central section and cap, respectively. A valance strip 18 is fitted to the underside of the central section 13A, which valance strip is of the same extrusion as strips 26.

The ridge member 12 comprises an extruded aluminium alloy central box member 30 (FIG. 4E) and a pair of channels 31 and 32 (FIG. 4P), one to each side of the box member. Each of the channels 31 and 32 is of the same extrusion as the extruded channel 20 forming the ring beam 10. The projections 28 from the base wall 21 of that extrusion serve to connect each channel to the respective side face of the box member 30, with the two flanges 22 projecting laterally away from the box member, more or less at the bottom of that member, and with the short flanges 23 uppermost. The side faces of the box member are provided with suitable grooves to receive the projections 28 of the base wall 21 of the channels, whereby those channels are securely attached to the box member and are prevented from disengaging by means of fixing screws 43 which pass through sections 30 and 31.

A capping strip 33 (FIG. 48) is fitted over the ridge beam, which strip a rests on the curved short flanges 23 of the two channels 31 and 32, the capping strip being held down by means of bolts (not shown) spaced along the strip and which has their heads located in channel 34 of the capping strip. Each bolt projects downwardly through aligned apertures in the upper and lower walls 35 and 36 of the box member, a nut being fitted to the bolt below wall 36. Sealing members 37 and 38 are fitted in respective grooves 39 and 40, at the free end of the short flange 23 and in an arm 41 extending away from that short flange. A further sealing member (not shown) may be fitted in a groove 42, at the free long edges of the capping strip 33.

The upper end 45 of each glazing bar 13 is carried on a support plate 46 (FIG. 4D) pivoted to the upper surface of the lower flange 22 of the respective channels 31 and 32. The lower end of each support plate has a re-entrant groove 47 extending therealong, in which is received the head 48 of a projecting bead 49 upstanding from the upper face of the long flange 22. In this way, the support plate 46 may pivot about a horizontal axis, to accommodate the angle at which the associated glazing bar 13 is to extend. Each glazing bar 13 has its own individual support plate, which can slide along the length of the ridge member to the required position.

Also extruded integrally with each channel, so as to extend generally from the junction between the base wall 21 and the long flange 22, is an arcuate receptor 50 having its curvature centred on the pivotal connection between the support plate 46 and the long flange 22. This receptor is provided with spaced teeth 51, the free end 52 of the support plate being engageable with a selected tooth, whereby each support plate may be slid into the ridge member at the appropriate angle for the roof under construction—and typically one of 15, 20, 25 or 30°. The upper end 45 of each glazing bars 13 may be secured to the part of its support plate between its pivotal connection to the long flange 22 and its free end engaged with the receptor by means of a nut and bolt, the head of the bolt being held captive but slidable along channel 54.

The undersides of the two long flanges 22 and of the lower wall 36 of the box member may be trimmed by three valance strips 53, snap-fitted to the long flanges 22. These valance strips 53 are of the same section as the strips 26, (FIG. 4C), fitted to the inwardly directed faces of the ring beam.

Figure 3:
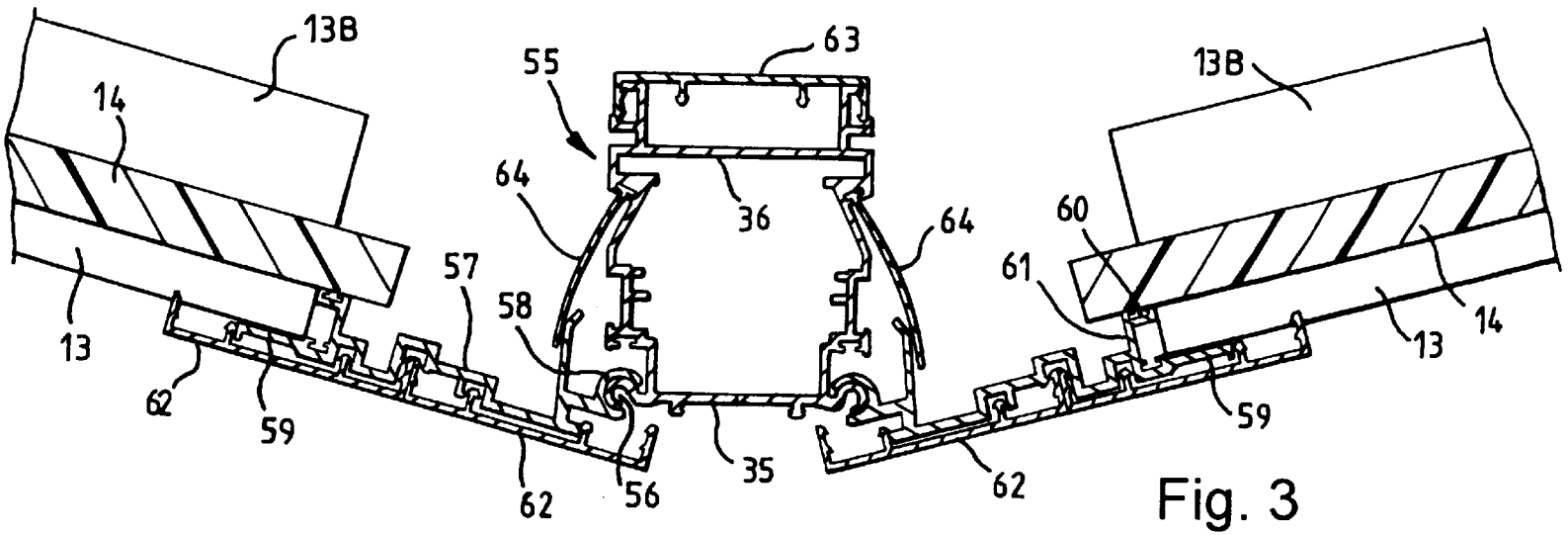
FIG. 3 is a vertical section through a valley member and connected glazing bars.

FIG. 3 shows in more detail the valley construction, supporting the lower ends of the glazing bars which intercept that valley. The valley member is assembled from a box member 55 (FIG. 4E) of the same extrusion as box member 30 of the ridge member, though used the other way up. As oriented for the valley, the box member 55 has a pair of ribs 56 one at each of its two lower comers respectively, the outer surface of each rib being of part circular form. A glazing bar carrier 57 (FIG. 4A) is pivoted to each of those ribs 56, each such carrier 57 having a reentrant channel 58 formed along an edge thereof and in which the respective rib 56 is received. The lower end of a glazing bar 13 may be secured to the carrier 57 by means of a screw-threaded fastener (not shown) extending through the free end portion 59 of the carrier. A seal (not shown) may be located in groove 60 formed at the upper end of arm 61 upstanding from the carrier.

Figure 4C:
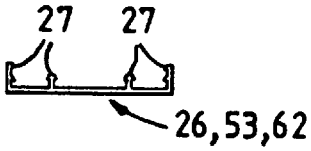
Figure 4D:
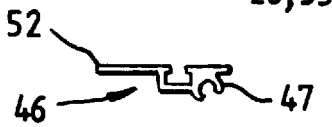
Figure 4E:
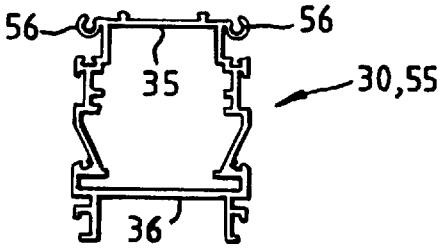
Figure 4F:
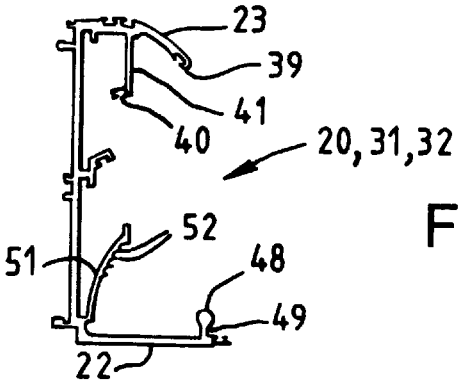

The lower surface of each carrier 57 is trimmed by a pair of valance strips 62 arranged side-by-side, each of which strips is of the same configuration as the strips 26 and 53 (FIG. 4C). Moreover, a further valance strip 63, again of the same configuration, is fitted to the top of the box member 55. Seals 64 are located in grooves in the box member 55 and bear against projections upstanding from the carrier 57.

As will be appreciated from the foregoing, the roof construction employs six principal extrusions or strips, as shown in FIGS. 4A to 4F, and several of those are used in different manners. This reduces the initial tooling costs, stocking requirements and numbers of components which have to be transported to a construction site, leading to significant economical advantages as compared to previous known constructions.

I claim:

1. A conservatory roof construction comprising:

(i) a ring beam adapted to be laid around a plurality of upper surfaces of conservatory walls;

(ii) a ridge member; and (iii) a plurality of glazing bars extending between said ridge member and said ring beam;

(iv) said ring beam comprising a channel which defines a surface for supporting the outer ends of said glazing bars;

(v) said ridge member comprising a central member and a pair of channels disposed one to each side of said glazing bars, each said ridge channel comprising a base wall, a relatively long flange upstanding from one edge of said base wall and a relatively short flange upstanding from the opposed other edge of said base wall, and said ridge channels being mounted with their said base walls extending along a respective side face of said central member, with said long flanges of said channels lowermost; and (vi) said channels of said ridge member and of said ring beam being essentially of the same sections, side faces of said central member and the outwardly directed faces of said channel base walls having interengaging portions whereby said channels are secured to said central member.

2. A conservatory roof construction as defined in claim 1, wherein said ring beam channel is adapted to be mounted with said base wall upstanding from the upper surface of the conservatory walls, with said long flange lowermost and with said flanges directed away from said ridge member.

3. The conservatory roof construction as defined in claim 1, wherein said short flange of said ring beam channel has an arcuate profile, curving towards said long flange away from said base wall of said channel.

4. The conservatory roof construction as defined in claim 1, wherein a plurality of ridge ends of said glazing bars are connected to said ridge member by an arcuate receptor centered on a pivot axis of said support plate and having a plurality of spaced engagement means with any one of which the end of said support plate remote from a pivotal connection of said ridge member may be engaged.

5. The conservatory roof construction as defined in claim 1, wherein said central member comprised a box member.

6. A conservatory roof construction, including:

(i) a ridge member;

(ii) a plurality of glazing bars each extending away from and having one end supported by said ridge member;

(iii) said one end of each glazing bar bearing on a respective support plate pivoted to said ridge member; and (iv) means for selectively setting the relative angle between said support plate and said ridge member comprising an arcuate receptor centered on a pivot axis of said support plate and having a plurality of spaced engagement means with any one of which the end of said support plate remote from a pivotal connection to said ridge member may be engaged.

7. The conservatory roof construction as defined in claim 6, wherein said ridge member has a laterally projecting flange, the pivotal connection between said support plate and said ridge member being arranged at or adjacent the outer end of said flange.

8. The conservatory roof construction as defined in claim 6, wherein said headed bead upstands from a surface of said ridge member and said re-entrant groove is provided on the underside of said support plate.

9. The conservatory roof construction as defined in claim 6, wherein each said glazing bar is secured to its respective said support plate by means of a screw-threaded fastener disposed between said pivotal connection of said support plate and the end of said support plate engaged with said receptor.

10. The conservatory roof construction as defined in claim 6, wherein an individual said support plate is provided for each said glazing bar, said support plate being slidable along the length of said ridge member to the required position to support its glazing bar.

11. A conservatory roof construction comprising:

(i) a ring beam adapted to be laid around a plurality of upper surfaces of conservatory walls;

(ii) a ridge member;

(iii) a plurality of glazing bars extending between said ridge member and said ring beam, and;

(iv) a valley member disposed between two sections of the roof lying in different planes and also extending between said ridge member and said ring beam;

(v) said ridge member comprising a first central member and a pair of ridge channels disposed one to each side of said first central member, said ridge channels defining surfaces for supporting a plurality of ridge ends of said glazing bars and said valley member comprising a second central member;

(vi) a pair of carriers mounted one to each side of said first central member for supporting a plurality of lower ends of said glazing bars terminating along said valley member;

(vii) said first central member of said ridge member being of substantially the same configuration as said second central member of said valley member.

12. The conservatory roof construction as defined in claim 11, wherein said central members of said ridge member and said valley member are aluminium alloy extrusions of the same section.

13. The conservatory roof construction as defined in claim 12, wherein each of said carriers is pivotally connected to a central box member of said valley member.

14. The conservatory roof construction as defined in claim 13, wherein one of said central member and said carrier is provided with a re-entrant groove into which a headed bead can be fitted to furnish said pivotal connection.

15. The conservatory roof construction as define in claim 14, wherein each of said two headed beads is extruded integrally with said central member of said valley member.

16. The conservatory roof construction as define in claim 11, wherein each of said carriers extends along the length of said central member of said valley member.

17. The conservatory roof construction as defined in claim 11, wherein said ridge ends of said glazing bars are connected to said ridge member by an arcuate receptor centered on a pivot axis of said support plate and having a plurality of spaced engagement means with any one of which the end of said support plate remote from a pivotal connection of said ridge member may be engaged.

18. A conservatory roof construction as defined in claim 11, wherein said ring beam and said ridge member are aluminum alloy extrusions of the same section.

19. A conservatory roof construction, comprising:

(i) a ring beam adapted to be laid around a plurality of surfaces of conservatory walls;

(ii) a ridge member;

(iii) a plurality of glazing bars extending between said ridge member and said ring-beam; and (iv) elongate valance strips;

(v) whereby inwardly-directed faces of said ring beam and said ridge member are trimmed with said elongate valance strips, each said valance strip being of substantially the same configuration.

20. The conservatory roof construction as defined in claim 19, wherein two said valance strips are arranged side-by-side to trim an inwardly directed face of said ring beam, and wherein three said valance strips are arranged side-by-side to trim an inwardly directed face of said ridge beam.

* * * * *

UNITED STATES PATENT AND TRADEMARK OFFICE

CERTIFICATE OF CORRECTION

PATENT NO. : 6,223,481 B1
DATED : May 1, 2001
INVENTOR(S) : Rickman

It is certified that error appears in the above-identified patent and that said Letters Patent is hereby corrected as shown below:

Column 10,
Line 1, replace "define" with -- defined --
Line 4, replace "define" with -- defined --

Signed and Sealed this

Fifteenth Day of January, 2002

*Attest:*

*Attesting Officer*

JAMES E. ROGAN
*Director of the United States Patent and Trademark Office*